US005615880A

United States Patent [19]

Booth et al.

[11] Patent Number: 5,615,880

[45] Date of Patent: Apr. 1, 1997

[54] ELECTRONIC GOAL DETECTING SYSTEM

[76] Inventors: Jason P. Booth; Deborah A. Booth, both of 660 Galloway Cres, Mississauga, Ontario, Canada, 006563001

[21] Appl. No.: 644,624

[22] Filed: May 6, 1996

[51] Int. Cl.[6] ..... A63B 63/00

[52] U.S. Cl. ..... 473/471; 273/371; 473/478; 473/570

[58] Field of Search ..... 273/371, 377, 273/57.2, 58 G, 126 R, 126 A, 127 R, 127 B, 128 R, 128 A, 128 CS, 118 A, 118 D, 55 R, 55 D

[56] References Cited

U.S. PATENT DOCUMENTS 3,970,310 7/1976 Gryschuk ..... 273/375
4,105,208 8/1978 Polhuis ..... 273/385
4,491,954 1/1985 Genuit ..... 377/5
4,492,380 1/1985 Saytar ..... 273/411
4,607,842 8/1986 Dadust ..... 273/57.2
5,356,135 10/1994 Montgomery ..... 273/57.2

*Primary Examiner*—William H. Grieb

[57] ABSTRACT

A new Electronic Goal Detecting System for accurately detecting and signaling if an object, such as a hockey puck or a hockey ball, passes through the goal posts of a hockey goal thereby preventing disagreements between players, and for displaying the total goals scored. The inventive device includes a hockey goal, a sensing means mounted to the hockey goal, an object such as a hockey puck or a hockey ball received by the hockey goal, a pickup means positioned within the hockey puck or the hockey ball detected by the sensing means, a power supply electronically attached to the sensing means, and a goal signal means electronically attached to the sensing means.

4 Claims, 3 Drawing Sheets

ELECTRONIC GOAL DETECTING SYSTEM

BACKGROUND OF THE INVENTION

1. Field of the Invention

The present invention relates to Goal Devices and more particularly pertains to a new Electronic Goal Detecting System for accurately detecting and signaling if an object, such as a hockey puck or a hockey ball, passes through the goal posts of a hockey goal thereby preventing disagreements between players, and for displaying the total goals scored.

2. Description of the Prior Art

The use of Goal Devices is known in tile prior art. More specifically, Goal Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Goal Devices include U.S. Pat. Nos. 4,492,380; 4,105,208; 3,970,310; 4,607,842; 5,356,135 and 4,491,954.

While these devices fulfill their respective, particular objectives and requirements, the aforementioned patents do not disclose a new Electronic Goal Detecting System. The inventive device includes a hockey goal, a sensing means mounted to the hockey goal, an object such as a hockey puck or a hockey ball received by the hockey goal, a pickup means positioned within the hockey puck or the hockey ball detected by the sensing means, a power supply electronically attached to the sensing means, and a goal signal means electronically attached to the sensing means.

In these respects, the Electronic Goal Detecting System according to the present invention substantially departs from the conventional concepts and designs of the prior art, and in so doing provides an apparatus primarily developed for the purpose of accurately detecting and signaling if an object, such as a hockey puck or a hockey ball, passes through the goal posts of a hockey goal thereby preventing disagreements between players, and for displaying the total goals scored.

SUMMARY OF THE INVENTION

In view of the foregoing disadvantages inherent in the known types of Goal Devices now present in the prior art, the present invention provides a new Electronic Goal Detecting System construction wherein the same can be utilized for accurately detecting and signaling if an object, such as a hockey puck or a hockey ball, passes through the goal posts of a hockey goal thereby preventing disagreements between players, and for displaying the total goals scored.

The general purpose of the present invention, which will be described subsequently in greater detail, is to provide a new Electronic Goal Detecting System apparatus and method which has many of the advantages of the Goal Devices mentioned heretofore and many novel features that result in a new Electronic Goal Detecting System which is not anticipated, rendered obvious, suggested, or even implied by any of the prior art Goal Devices, either alone or in any combination thereof.

To attain this, the present invention generally comprises a hockey goal, a sensing means mounted to the hockey goal, an object such as a hockey puck or a hockey ball received by the hockey goal, a pickup means positioned within the hockey puck or the hockey ball detected by the sensing means, a power supply electronically attached to the sensing means, and a goal signal means electronically attached to the sensing means.

There has thus been outlined rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Electronic Goal Detecting System apparatus and method which has many of the advantages of the Goal Devices mentioned heretofore and many novel features that result in a new Electronic Goal Detecting System which is not anticipated, rendered obvious, suggested, or even implied by any of the prior art Goal Devices, either alone or in any combination thereof.

It is another object of the present invention to provide a new Electronic Goal Detecting System which may be easily and efficiently manufactured and marketed.

It is a further object of the present invention to provide a new Electronic Goal Detecting System which is of a durable and reliable construction.

An even further object of the present invention is to provide a new Electronic Goal Detecting System which is susceptible of a low cost of manufacture with regard to both materials and labor, and which accordingly is then susceptible of low prices of sale to the consuming public, thereby making such Electronic Goal Detecting System economically available to the buying public.

Still yet another object of the present invention is to provide a new Electronic Goal Detecting System which provides in the apparatuses and methods of the prior art some of the advantages thereof, while simultaneously overcoming some of the disadvantages normally associated therewith.

Still another object of the present invention is to provide a new Electronic Goal Detecting System for accurately detecting and signaling if an object, such as a hockey puck or a hockey ball, passes through the goal posts of a hockey goal thereby preventing disagreements between players, and for displaying the total goals scored.

Yet another object of the present invention is to provide a new Electronic Goal Detecting System which includes a hockey goal, a sensing means mounted to the hockey goal, an object such as a hockey puck or a hockey ball received by the hockey goal, a pickup means positioned within the hockey puck or the hockey ball detected by the sensing means, a power supply electronically attached to the sensing means, and a goal signal means electronically attached to the sensing means.

Even still another object of the present invention is to provide a new Electronic Goal Detecting System that accurately detects goals scored preventing disagreements between players.

Another object of the present invention is to display the total goals scored during the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
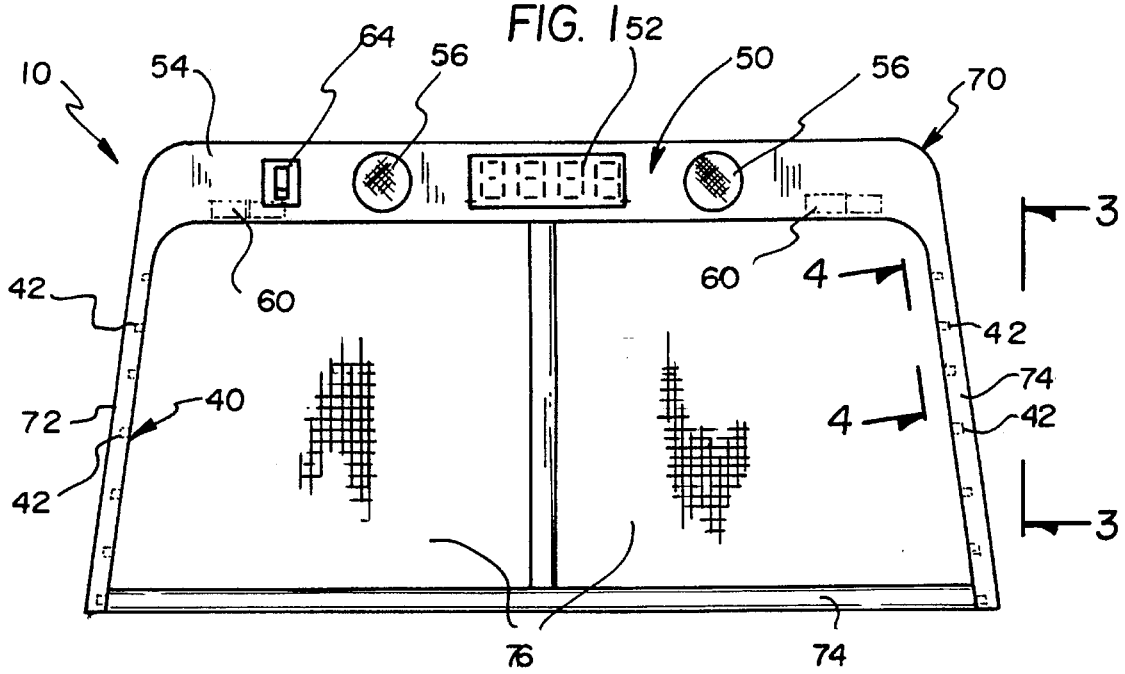
FIG. 1 is a front view of a new Electronic Goal Detecting System according to the present invention.

With reference now to the drawings, and in particular to FIGS. 1 through 6 thereof, a new Electronic Goal Detecting System embodying the principles and concepts of the present invention and generally designated by the reference numeral 10 will be described.

Figure 5:
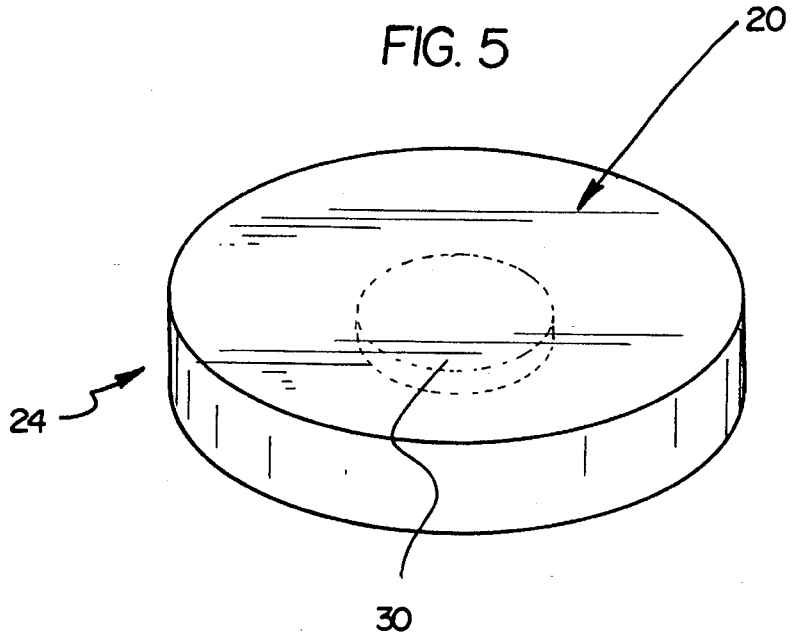
FIG. 5 is an upper perspective view of a hockey puck with a pickup means positioned within.
Figure 6:
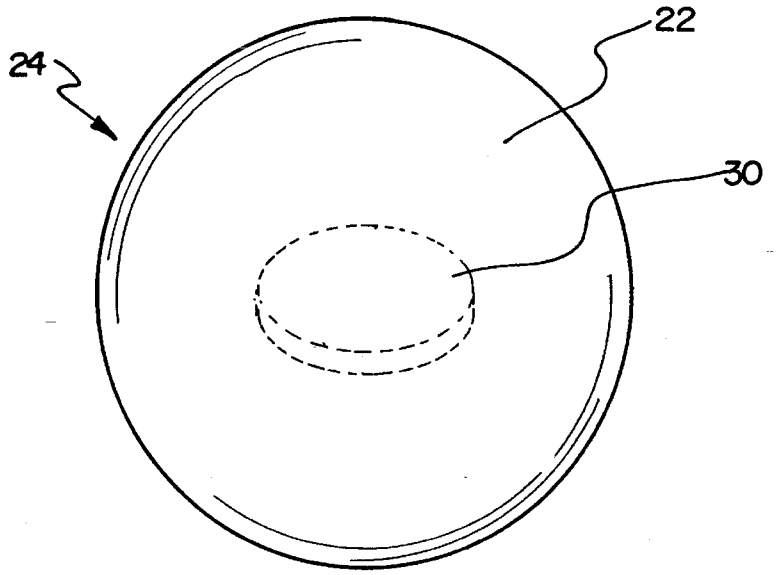
FIG. 6 is an upper perspective view of a hockey ball with a pickup means within.

More specifically, it will be noted that the Electronic Goal Detecting System 10 comprises a hockey goal 70, a sensing means 40 secured to the hockey goal 70, a goal signal means 50 attached to the upper front portion of the hockey goal 70, a power supply 60 electronically connected to the goal signal means 50 and sensing means 40, an object 24 such as a hockey puck 20 or hockey ball 22 which is received by the hockey goal 70 as best shown in FIGS. 5–6 of the drawings, and a pickup means 30 positioned within the hockey puck 20 or the hockey ball 22.

Figure 2:
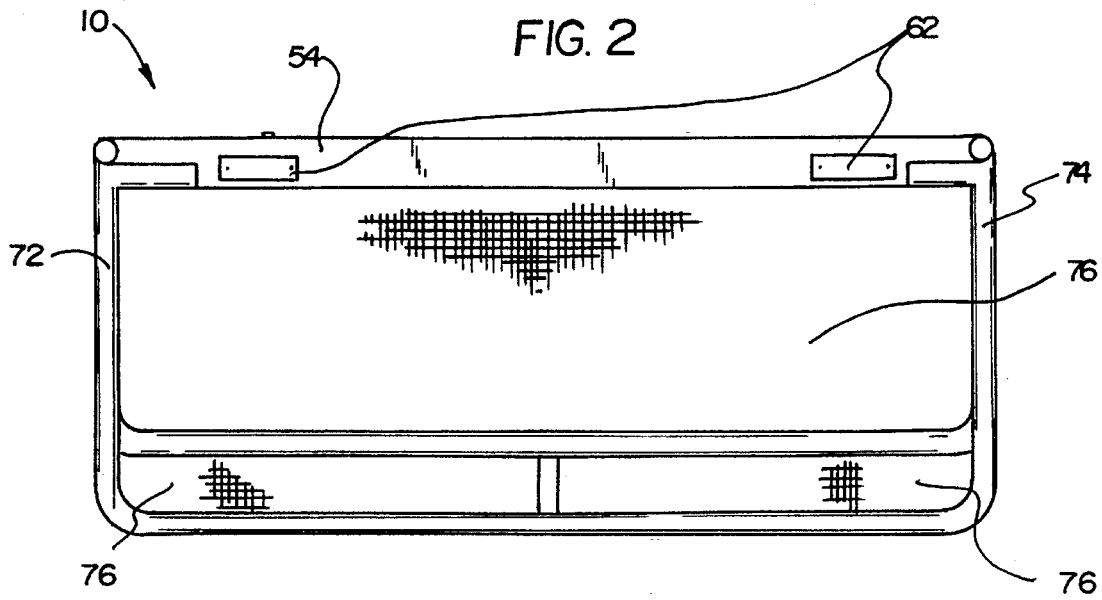
FIG. 2 is a bottom view thereof.
Figure 3:
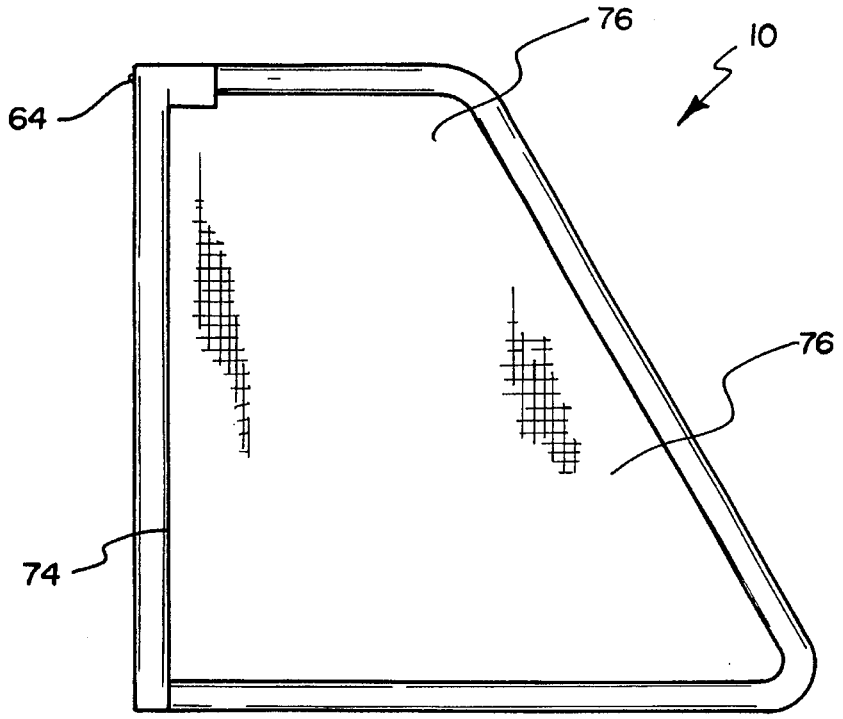
FIG. 3 is a side view of the present invention.
Figure 4:
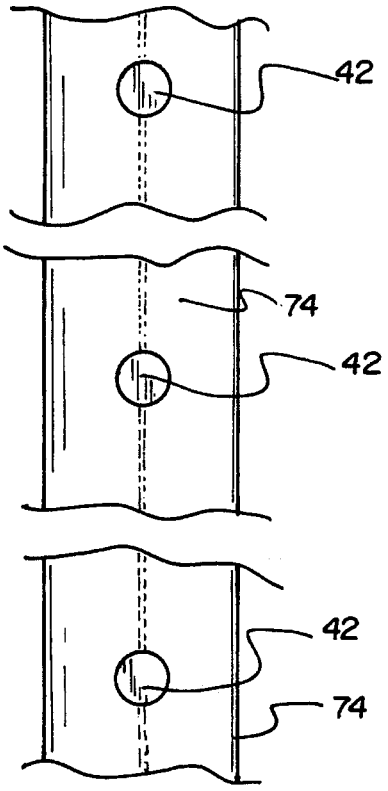
FIG. 4 is a cross sectional view taken along line 4—4 of FIG. 1 disclosing the sensing means.

As best illustrated in FIGS. 1, it can be shown that the sensing means 40 includes a plurality of sensors 42 secured to a first side goal member 72 facing towards a second side goal member 74 detecting the pickup means 30. As best shown in FIGS. 1 and 4 of the drawings, a plurality of sensors 42 are secured to the second side goal member 74 facing towards the first side goal member 72 detecting the pickup means 30. The goal signal means 50 includes a front support member 54 secured to the upper front portion of the hockey goal 70. An LED display 52 is secured to the front support member 54 and is electronically connected to the sensing means 40 which controls the LED display 52. A battery door 62 is rotatably secured to the bottom of the front support member 54 allowing insertion and removal of unnumbered batteries as best illustrated by FIG. 2 of the drawings. A speaker 56 is secured to the front support member 54 and is electronically connected to the sensing means 40 which controls the sound produced by the speaker 56. The power supply 60 includes a power switch 64 secured to the front support member 54.

In use, the user closes the power switch 64 activating the sensing means 40 and the goal signal means 50. The user then shoots an object 24 such as the hockey puck 20 or the hockey ball 22 into the hockey goal 70. As the object 24 projects through the plane between the first side goal member 72 and the second side goal member 74, the plurality of sensors 42 on the goal members 72 and 74 detect the pickup means 30 within the object 24. After detection of the pickup means 30, the sensing means 40 electronically activates the speaker 56 and electronically engages the LED display 52 to inform the user that a goal has been scored.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Electronic Goal Detecting System comprising:

a hockey goal;

a sensing means secured to the hockey goal;

a goal signal means attached to the upper front portion of the hockey goal;

a power supply electronically connected to the goal signal means and the sensing means;

a hockey puck or hockey ball which is received by the hockey goal; and a pickup means positioned within the hockey puck or the hockey ball.

2. The Electronic Goal Detecting System of claim 1, wherein the sensing means includes a plurality of sensors secured to a first side goal member facing towards a second side goal member detecting the pickup means; and a plurality of sensors secured to the second side goal member facing towards the first side goal member detecting the pickup means.

3. The Electronic Goal Detecting System of claim 2, wherein the goal signal means includes a front support member secured to the upper front portion of the hockey goal; an LED display secured to the front support member and electronically connected to the sensing means; a battery door rotatably secured to the bottom of the front support member; and a speaker physically secured to the front support member and electronically connected to the sensing means.

4. The Electronic Goal Detecting System of claim 3, wherein the power supply includes a power switch secured to the front support member.

* * * * *